US012078438B2

(12) United States Patent
Boling et al.

(10) Patent No.: US 12,078,438 B2
(45) Date of Patent: Sep. 3, 2024

(54) METHOD OF IMPROVING THE MECHANICAL COMMUNICATION BETWEEN COMPONENTS OF A FIREARM

(71) Applicants: Derek Scott Boling, Portage, IN (US); David Jude Fappiano, Evans, GA (US)

(72) Inventors: Derek Scott Boling, Portage, IN (US); David Jude Fappiano, Evans, GA (US)

( * ) Notice: Subject to any disclaimer, the term of this patent is extended or adjusted under 35 U.S.C. 154(b) by 181 days.

(21) Appl. No.: 17/814,253

(22) Filed: Jul. 22, 2022

(65) Prior Publication Data

US 2023/0175796 A1 Jun. 8, 2023

Related U.S. Application Data

(60) Provisional application No. 63/286,970, filed on Dec. 7, 2021.

(51) Int. Cl.
*F41A 3/66* (2006.01)

(52) U.S. Cl.
CPC ..... *F41A 3/66* (2013.01)

(58) Field of Classification Search
CPC ..... F41A 3/66
USPC ..... 156/60
See application file for complete search history.

(56) References Cited

U.S. PATENT DOCUMENTS

| | | | | |
|---|---|---|---|---|
| 7,946,075 | B2 | 5/2011 | Nasef | |
| 9,032,860 | B2 | 5/2015 | Faxon | |
| 9,279,638 | B2 | 3/2016 | Adair et al. | |
| 9,289,867 | B2 | 3/2016 | Turner, Jr. et al. | |
| 9,400,006 | B1 | 7/2016 | Huang et al. | |
| 9,568,261 | B1 | 2/2017 | Hall | |
| 10,222,149 | B2 | 3/2019 | Daley, Jr. | |
| 10,337,827 | B1 | 7/2019 | Holmes et al. | |
| 10,391,591 | B2 | 8/2019 | Smith | |
| 10,458,734 | B2 | 10/2019 | Faxon | |
| 10,514,218 | B2 | 12/2019 | Afshari | |
| 10,627,177 | B2 | 4/2020 | Hamilton | |
| 2013/0055610 | A1 | 3/2013 | Watkins | |
| 2014/0075802 | A1* | 3/2014 | Dubois | F41A 11/00 42/16 |
| 2015/0323269 | A1 | 11/2015 | McGinty | |
| 2018/0087854 | A1 | 3/2018 | Gray | |
| 2020/0064090 | A1 | 2/2020 | Russell | |
| 2022/0126973 | A1* | 4/2022 | Ripoll | F25B 13/00 |

* cited by examiner

*Primary Examiner* — S. Behrooz Ghorishi
*Assistant Examiner* — Gregory C. Grosso
(74) *Attorney, Agent, or Firm* — Dunlap Bennett & Ludwig, PLLC

(57) ABSTRACT

A method of improving the mechanical communication between two firearm components. The method embodies shim tape having a thin metallic layer with adhesive along one surface. The shim tape may be adhered along an interface between the two firearm components so as to fill space therebetween, thereby increasing their mechanical communication whereby associated wobble is minimized.

6 Claims, 4 Drawing Sheets

METHOD OF IMPROVING THE MECHANICAL COMMUNICATION BETWEEN COMPONENTS OF A FIREARM

CROSS-REFERENCE TO RELATED APPLICATION

This application claims the benefit of priority of U.S. provisional application No. 63/286,970, filed 7 Dec. 2021, the contents of which are herein incorporated by reference.

BACKGROUND OF THE INVENTION

The present invention relates to firearms and, more particularly, a method for improving the operative association between components of a firearm, including but not limited to using shim tape to improve the mechanical communication of the upper and lower receivers of the AR-15/AR-10/M16/M4/SR15&25 weapons platform. The shim tape may be aluminum layer with an adhesive backing.

Misalignment or wobble from side to side of the AR-15/AR-10/M16/M4/SR-15&25 upper and lower receivers, its stock fitment on the buffer tube's slidable association with the stock shoulder, and the clamping of optic element to its scope rings, can undermine the performance and the serviceability of these types of firearms.

According to Army study guide, it is critical for Soldiers to adhere to the Noise, Light, and Litter Discipline doctrine in accordance with Army Common Tasks SMCT, Skill Level 1 071-331-0815 (SL1).

In compliance with ARMY™ 9-1005-319-23&P AIR FORCE TO 11W3-5-5-42 during weapons inspection the following steps are performed to ensure the weapon is serviceable and in good working order. The test to determine this is as follows:

(a) Apply hand pressure to push the upper receiver as far to one side as possible.

(b) Attempt to insert a 0.020-inch thickness gage between the pivot pin lugs of the upper and lower receivers.

(c) If the thickness gage penetrates to the pivot pin at all accessible locations, repair by replacement of the upper receiver (see (b) below) or replacement of rifle is required.

If the rifle fails the above test, remove the upper receiver, and install a new upper receiver and perform the test again. If the rifle now passes the above test, it shall be considered serviceable and continue in use. If the rifle falls the test with a new upper receiver, this failure shall be considered a shortcoming. This shortcoming requires action to obtain a replacement rifle. Once a replacement has been received, evacuate the original rifle to depot for overhaul. By following the steps of this Utility patent, it has the potential to save the government and the Department of Defense money.

Current solutions for fixing the wobble resulting for misalignment and/or suboptimal fitment between mechanically communicating firearm components are flawed in that they shift tension between the mechanically communicating parts. These solutions, such as use of Accu-Wedge™, Accu-Screws™, and Accu-Washer™, introduce a pressure imbalance between the mechanically communicating parts, negatively impacting overall firearm performance. For instance, the current solutions can place upward tension or pressure on the takedown lug of the upper receiver when these solutions are used to shore up its mechanically communication with the lower receiver ears but does not take the wobble-inducing space away between the parts. In other words, current solutions do not fill the space or gap between the lug and mechanically communicating ear portions of the receiver groups, and this lack of tight or snug fit frustrates the purpose by inducing wobble. Also insufficient are "Power Custom™" shims or "X-shims Upper and Lower Receiver Shim Kit"™ for an AR-15, as these shims get smashed and once again do not remove the side-to-side movement between the receiver groups.

As can be seen, there is a need for a shim in the form of adhesive tape embodied in a method for improving the operative association between components of a firearm, including but limited to the mechanical communication of the upper and lower receivers of the AR-15/AR-10/M16/M4/SR15&25 weapons platform. The shim tape embodied in the present invention may have an aluminum layer that is soft enough to fill gaps and voids between the upper receiver lug coming together with the lower receiver pivot pin ears, thereby offering a true fix to upper and lower receiver groups shifting from side to side during use.

SUMMARY OF THE INVENTION

In one aspect of the present invention, a method of increasing a mechanical communication between two operatively associated firearm components, the method includes adhering shim tape along a surface of a first component of the two operatively associated firearm components at an interface of the mechanical communication.

In another aspect of the present invention, the above method includes wherein the shim tape comprising a shim layer with adhesive along a first surface thereof, wherein a second surface of the shim layer mechanically communicates with a second component of the two operatively associated firearm components, wherein the shim layer is configured to plastically deform against the second component under force, and wherein the shim layer is an aluminum sheet having a uniform thickness of between approximately 2.5 to 3.9 millimeters.

In yet another aspect of the present invention, the above method includes wherein the first component is a lug of an upper received and the second component are ears of a lower receiver, wherein the interface is between a first lateral side of the lug and a first inward face of one of the ears, wherein the interface further includes a second lateral side of the lug and a second inward face of the other ear, and urging a pivot pin through an aperture one of the ears and through a bore of the lug so that an opening is formed in the shim tape, wherein the interface further includes a rearward wall of the lug and a forward-facing wall of a portion of the lower receiver.

These and other features, aspects and advantages of the present invention will become better understood with reference to the following drawings, description and claims.

DETAILED DESCRIPTION OF THE INVENTION

Figure 1A:
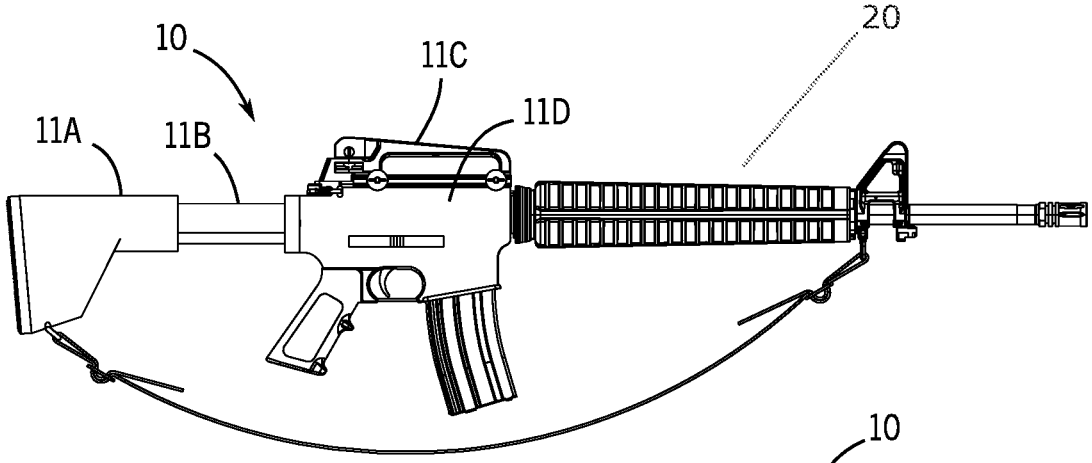
FIG. 1A is a side elevation view of a firearm using an exemplary embodiment of the present invention.
Figure 1B:
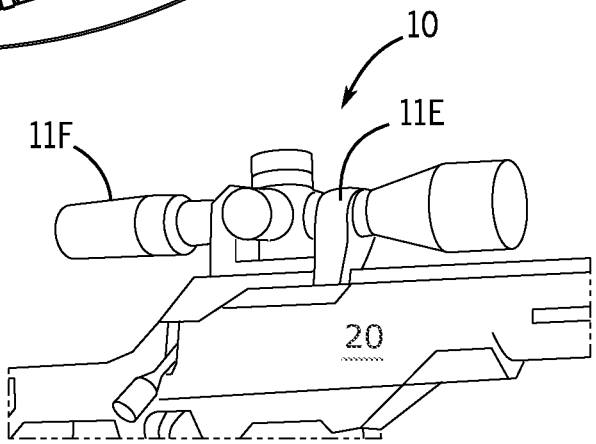
FIG. 1B is a detailed perspective view of a firearm using an exemplary embodiment of the present invention.
Figure 2:
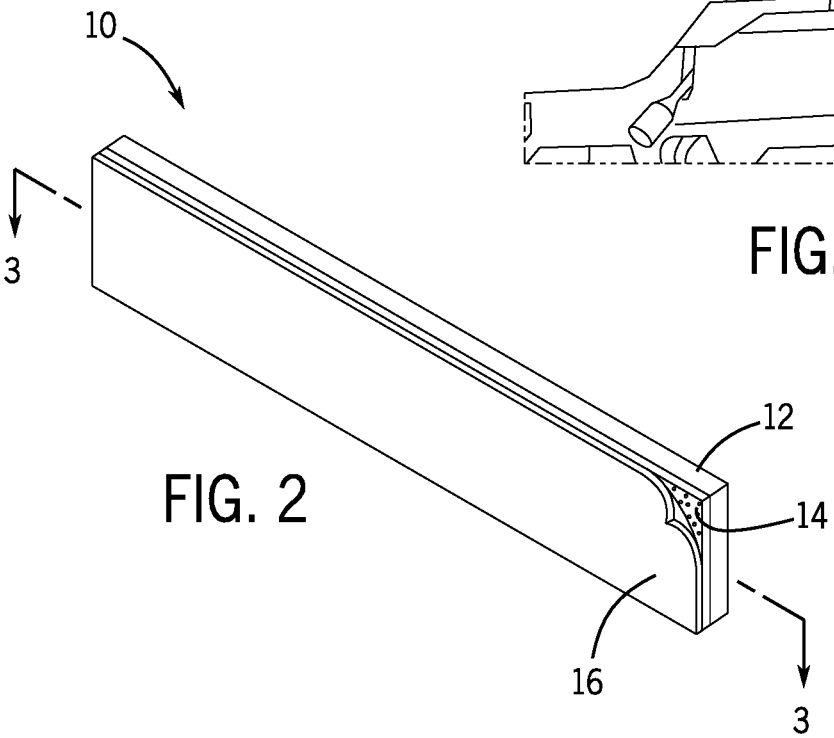
FIG. 2 is a perspective view of an exemplary embodiment of the present invention.
Figure 3:
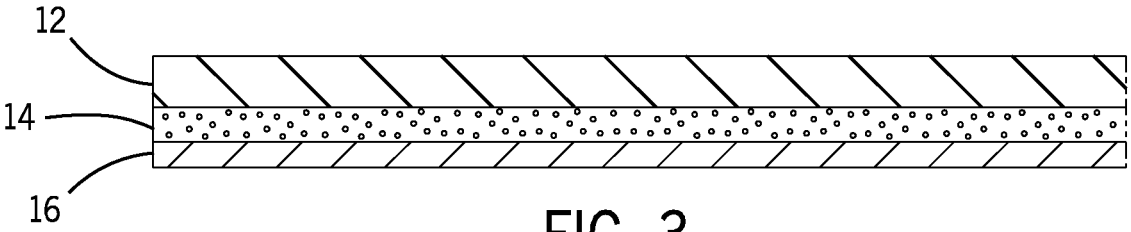
FIG. 3 is a cross-sectional view of an exemplary embodiment of the present invention, taken along line 3-3 in FIG. 2.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a method of improving the mechanical communication between two firearm components. The method embodies shim tape having a thin metallic layer with adhesive along one surface. The shim tape may be adhered along an interface between the two firearm components so as to fill space that would otherwise persist between the two firearm components, thereby increasing their mechanical communication whereby associated wobble is minimized.

Referring now to FIGS. 1A through 3, the present invention may include a method of improving the mechanical communication between two components of a firearm 20. The firearm 20 may include AR-15/AR-10/M16/M4 or other firearm platforms. The method may embody a systemic shim tape 10. The systemic shim tape 10 may include a shim layer 12 such as paper, plastic, or metallic substrate, foil, film, or the like. In some embodiments, the shim layer may be aluminum. The shim layer 12 has an adhesive 14 coated onto one side of the shim layer 12. The adhesive may be pressure sensitive or the like. A release layer 16 or peel-away layer 16 may physically engage the adhesive 14 prior to installation, at which time the release layer 16 may be peeled away.

Figure 4A:
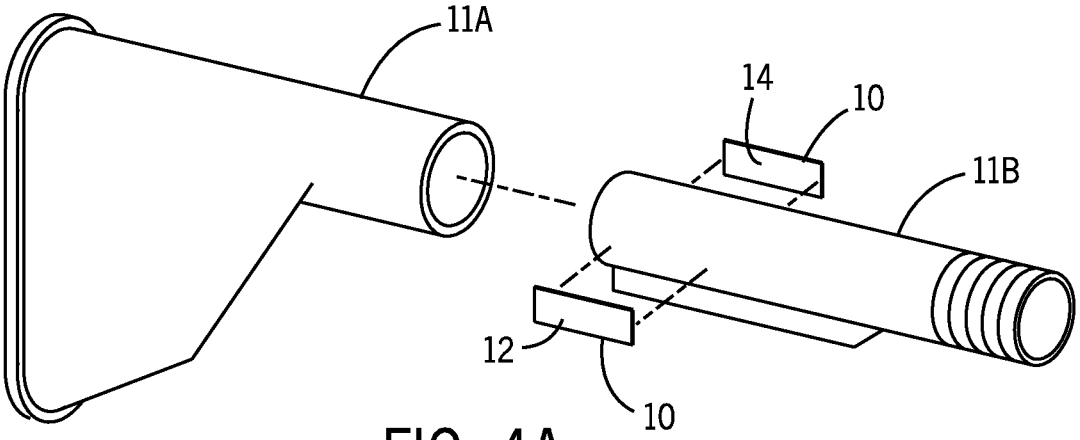
FIG. 4A is an exploded perspective view of an exemplary embodiment of the present invention, shown in a first used condition for improving the operative association and mechanical communication of a stock arm 11B and a stock shoulder 11A, showing placement of shim tape 10 on each opposing side of the stock arm 11B, illustrating a first assembly step for the first used condition.
Figure 4B:
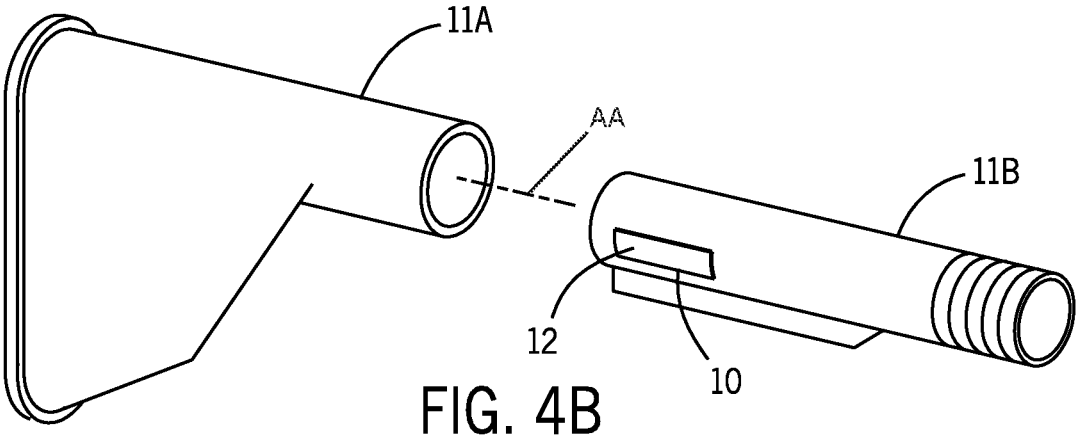
FIG. 4B is an exploded perspective view of said first assembly step, showing placement of the shim tape 10 along the stock arm 11B.
Figure 4C:
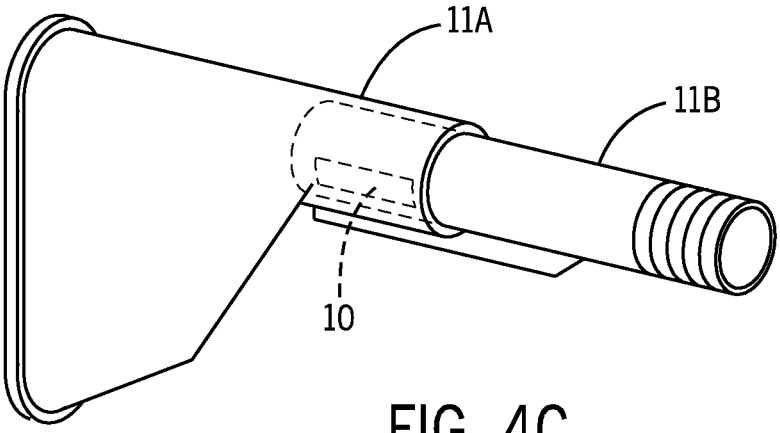
FIG. 4C is a perspective view of the first used condition showing the improved mechanical communication and fitment of the shimmed stock arm 11B assembly in the stock shoulder 11A, illustrating the second assembly step of the first used condition.

Referring to FIGS. 4A-4C, two of the components of the firearm 20 that are mechanically communicated may be a stock shoulder 11A and a stock arm 11B. A gunstock has a back portion known as a shoulder stock 11A that operatively associates with a stock arm 11B, wherein the stock shoulder 11A slidably receives the stock arm 11B for providing structural support for the firearm 20.

A method of improving the mechanical communication between the stock arm 11B and the stock shoulder 11A may include the following. A user may clean up the buffer tube of the stock arm 11B with a degreaser. Then the user may affix the shim tape 10 length wise, parallel with the longitudinal axis AA of the tubular portion of the stock arm 11B, wherein one piece of shim tape 10 is diametrically opposing another piece of shim tape 10 along the outer surfaces of the stock arm 11B. The user is cautioned not to affix the shim tape 10 to the bottom of the stock arm 11B, wherein the carbine length of pull adjustment takes place. Then the user may slide buttstock into the stock shoulder 11A to a desired length of pull.

Figure 5:
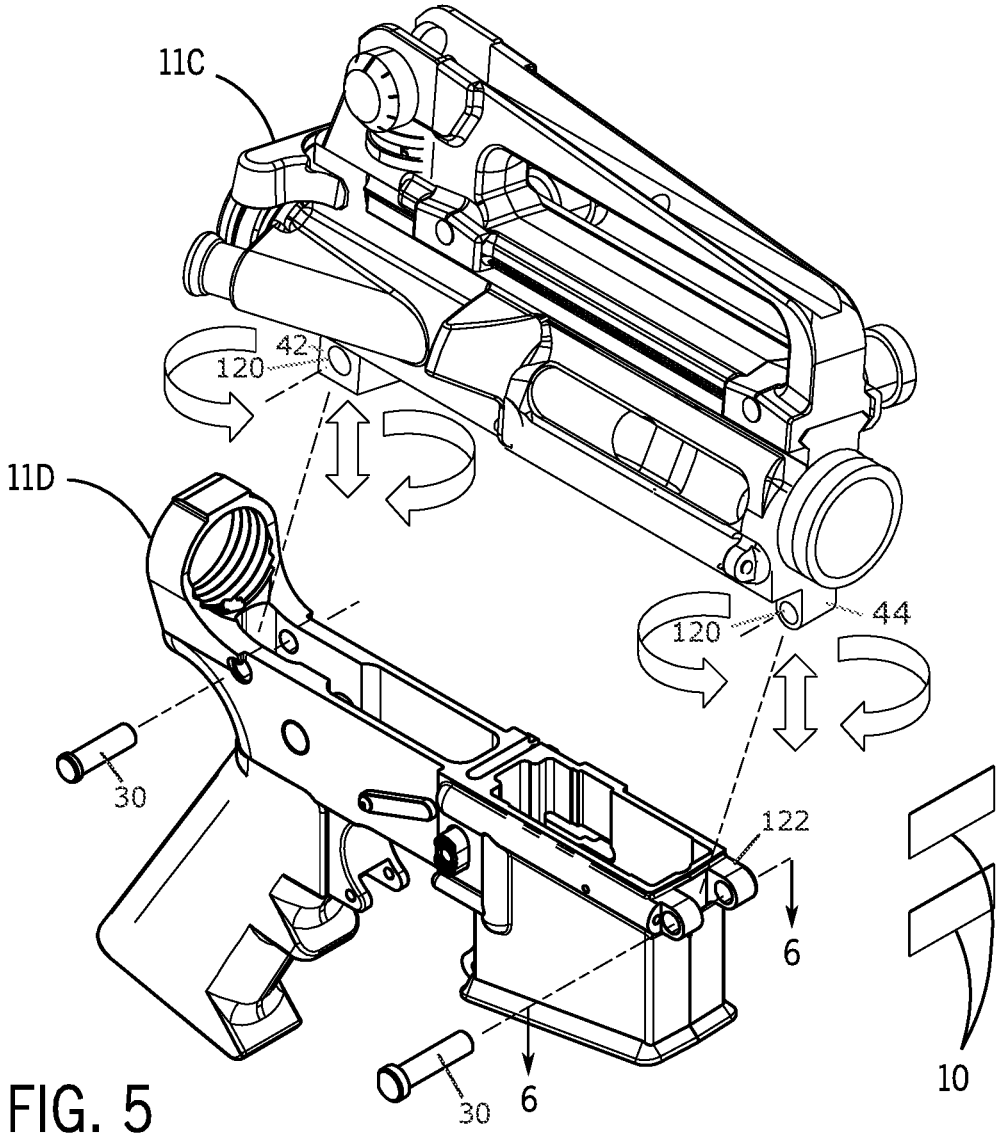
FIG. 5 is an exploded perspective view of an exemplary embodiment of the present invention, shown in a second used condition for improving the operative association and mechanical communication of an upper firearm receiver 11C and a lower firearm receiver 11D.

Referring to FIG. 5, two of the components of the firearm 20 that are mechanically communicated may be an upper receiver 11C and a lower receiver 11D. The upper receiver 11C is adapted to be longitudinally positioned and secured to the lower receiver 11D, laterally about and above a section of the firearm 20. The lower receiver 11D may include a rear portion having two openings or apertures 120 transversely aligned. The lower receiver 11D may include a front portion having two openings or apertures 120 transversely aligned through respective ears 122 on opposing sides of the housing of the lower receiver 11D. The diameters of the openings or apertures 120 are slightly larger than the diameter of a pivot pin 30 and are transversely aligned for receiving the pivot pin 30.

The upper receiver 11C provides a rear lug 42 and a front lug 44, wherein each lug 42 and 44 provides transverse bores 40 dimensioned and adapted to operatively associate with the apertures 120 of the rear portion and the front portion/ears 122, respectively. When installing the upper receiver 11C on the firearm 20, the user positions the lower receiver 11D such that the rear and front bores 40 align with the rear and front apertures 120, respectively. As such, the rear lug 42 may be slidably received by the lower receiver 11D housing, and wherein front lug 44 is received such that the ears 122 straddle the front lug 44. At this point, the user may insert the pivot pin 30 through aligned apertures 120 and bore 40, and then the pivot pin 30 may be secured to the receivers 11C and 11D by suitable means.

However, there may existed over tolerance or misalignment between the lateral sides 46 of the front lug 44 and the inward faces 126 of the ears 122, and a resulting space that tends to induce wobble between a rearward wall 48 of the front lug 44 and a forward-facing wall 128 of the portion of the lower receiver 11D.

Figure 6:
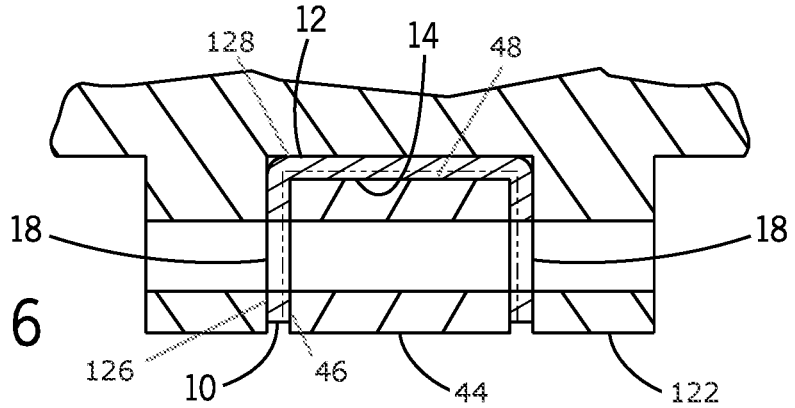
FIG. 6 is a cross-sectional view of an exemplary embodiment of the present invention, taken along line 6-6 in FIG. 5.

Referring to FIG. 6, the method embodied in the present invention for improving the mechanical communication between the front lug 44 and the ears 122 may include the following. A user may clean the front lug 44, especially the lateral sides 46 and the rearward wall 48 with a degreaser. After measuring and marking the lateral sides 46 and the rearward wall 48, the shim tape 10 may be cut to fitment along these surfaces. A hole 18 may be cut into two holes 18 (one hole 18 in two separate pieces of shim tape 10 or in two different portions of the same shim tape 10) so that the holes 18 have diameters slightly larger than the diameter of the pivot pin 30. Note, two shims on the front lug 44 is recommended. The user may remove the release layer 16 exposing the adhesive 14, and then adhere the shim tape 10 (by way of the adhesive surface of the shim layer 12) to the lateral sides 46 and the rearward wall 48, wrapping the shim tape 10 around lug 44 with the top (non-adhesive surface of the shim layer 12) of the shim tape 10 aligning with the top edge of the lateral inward faces 126 and the forward-facing wall 128 of the ears 122, respectively, for alignment purposes. The user may cut off any excess shim tape 10 ending the wrap on the flat surfaces of the lug 44. The user should not end wrap on the pivot pin hole sides. And then the user may place upper receiver 11C into the lower receiver pivot pins ears 122 (or rear slot for the rear lug 42) as mentioned above.

An alternative means of utilizing the present invention may include using the installation of the pivot pin 30 to punch through the adhered shim tape 10 that previously was not cut to form said hole 18, thereby forming the properly sized hole 18 at installation. Then the user may remove all shim 20 material that is pressed through the pivot pin bores 40 and apertures 120. The user may add additional layers if needed for all applications of shim tape 10. A similar process may be followed for correcting misalignment, over-tolerance, and/or wobbling associated with the rear lug 42.

In one embodiment, a piece of shim tape 10 may be approximately half-an-inch in width, approximately six inches in length, and 2.5 to 3.9 millimeters (mm) in thickness. Said piece of shim tape 10 may be wrapped around the upper receiver lug(s) 44 and/or 42. Then the user may reassemble the upper and lower receivers using the take down pin holes (bores 40 and apertures 120) to realign the two sections. Using a punch or the lower receivers takedown lug pin 30, the hole 18 may be punched through the piece of adhered shim tape 10. The piece of shim tape 10 will self-calibrate, compress, or plastically deform filling all voids between the upper lugs 42 and 44 and lower structures or ears 122, filling the spec tolerances between attaching the upper and lower receiver groups. Plastic deformation being the permanent deformation or change in shape of the shim layer 12 without fracture under the action of sustained urging by the user and/or between the two firearm components. It is recommended to replace the one or more piece of shim tape 10 every time a customer disassembles their AR-15/AR-10/M16/M4 platforms for maintenance. The present invention will cause no damage to the upper and lower receivers and leave no adhesive behind.

Figure 7:
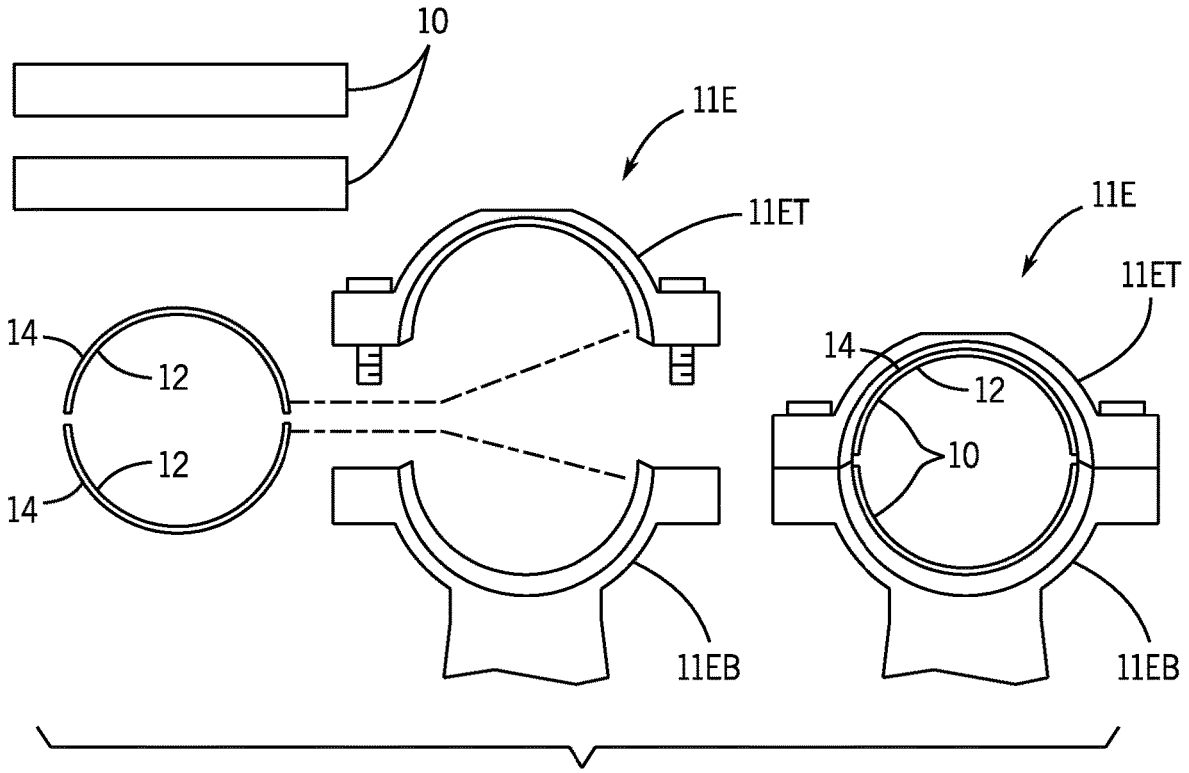
FIG. 7 shows a pre-assembled exploded elevation view and a post-assembly elevation of a third used condition of an exemplary embodiment of a method of improving the operative association and mechanical communication of a horizontal scope mounting assembly 11E (the first top component 11ET and the second bottom component 11EB thereof), thereby illustrating the assembly steps of the third used condition.
Figure 8:
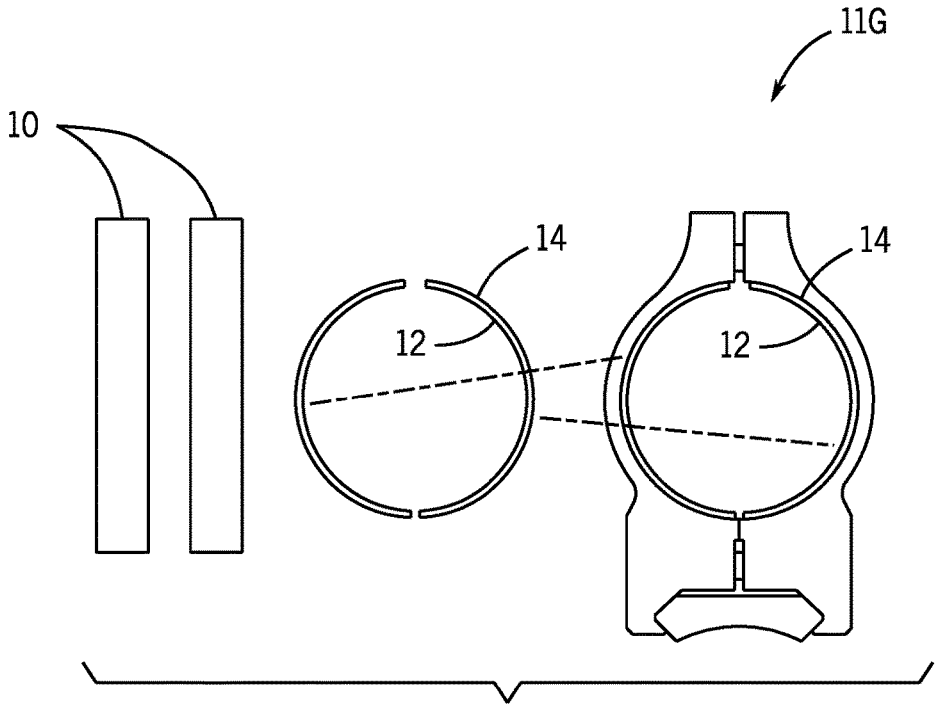
FIG. 8 is an exploded elevation view of an exemplary embodiment of a method of improving the operative association and mechanical communication of a vertical scope mounting assembly 11G, illustrating the assembly step.

Referring to FIGS. 7 and 8, two of the components of the firearm 20 that are mechanically communicated may be an optic element 11F and a scope mount (horizontal 11E or vertical 11G orientated). Either scope mount 11E or 11G may define an inner circumferential surface for mechanically communicating with an outer circumferential surface of the scope 11F. The inner circumferential surface may be a product of a first approximately semicircular scope ring 11ET and a second scope approximately semicircular scope ring 11EB that when joined define said inner circumferential surface.

A user may clean the inside first and second scope rings 11ET and 11EB with a degreaser. It is recommend using the radius measurements of the inner diameter of the scope rings 11ET and 11EB prior to the user cutting the shim tape 10 to cooperative lengths and widths for placing the shim tape 10 on one or both scope rings 11ET and 11EB so that the mechanically communicating optic element (e.g., scope) 11F in a desired location.

For the methods disclosed herein, the end user may apply a small amount of lubricant to the shim tape 10 to slide easier into the pivot pin ears 122 or slot of the lower receiver for the rear upper receiver pivot pin lug 42 and 44.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object.

Further, for purposes of this disclosure, the term "mechanical communication" generally refers to components being in direct physical contact with each other or being in indirect physical contact with each other where movement of one component affects the position of the other.

The use of all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A method of increasing a mechanical communication between two operatively associated firearm components, the method comprising:

adhering shim tape along a surface of a first component of the two operatively associated firearm components at an interface of the mechanical communication, wherein the shim tape comprising a shim layer with adhesive along a first surface thereof, wherein a second surface of the shim layer mechanically communicates with a second component of the two operatively associated firearm components, wherein the shim layer is configured to plastically deform against the second component under force, and wherein the shim layer is an aluminum sheet having a uniform thickness of between approximately 2.5 to 3.9 millimeters.

2. The method of claim 1, wherein the first component is a lug of an upper receiver and the second component are ears of a lower receiver.

3. The method of claim 2, wherein the interface is between a first lateral side of the lug and a first inward face of one of the ears.

4. The method of claim 3, wherein the interface further includes a second lateral side of the lug and a second inward face of the other ear.

5. The method of claim 4, further comprising urging a pivot pin through an aperture one of the ears and through a bore of the lug so that an opening is formed in the shim tape.

6. The method of claim 3, wherein the interface further includes a rearward wall of the lug and a forward-facing wall of a portion of the lower receiver.

* * * * *